US005161879A

United States Patent [19]

McDermott

[11] Patent Number: 5,161,879

[45] Date of Patent: Nov. 10, 1992

[54] FLASHLIGHT FOR COVERT APPLICATIONS

[76] Inventor: Kevin McDermott, 196 Phillips Dr., Hampstead, Md. 21074

[21] Appl. No.: 682,964

[22] Filed: Apr. 10, 1991

[51] Int. Cl.[5] ..... F21L 7/00

[52] U.S. Cl. ..... 362/206; 362/227; 362/231; 362/240; 362/800; 200/60; 200/61.52

[58] Field of Search ..... 362/204, 205, 206, 118, 362/158, 189, 208, 231, 293, 800, 240; 200/60, 61.52, DIG. 29, 61.83, 61.45 R; 359/501

[56] References Cited

U.S. PATENT DOCUMENTS

| | | | |
|---|---|---|---|
| 1,358,639 | 11/1920 | King | 200/DIG. 29 |
| 2,347,531 | 4/1944 | Yardeny | 362/206 |
| 2,732,543 | 1/1956 | Mogren | 200/61.52 |
| 4,517,628 | 5/1985 | McDermott | 362/186 |
| 4,677,533 | 6/1987 | McDermott et al. | 362/240 |
| 4,697,890 | 10/1987 | Crooston | 359/501 |
| 4,947,291 | 8/1990 | McDermott | 362/19 |
| 4,963,798 | 10/1990 | McDermott | 315/312 |

*Primary Examiner*—James C. Yeung

[57] ABSTRACT

A flashlight for security personnel has a gravity actuated switch for application of electrical power to multiple lamps to enable the projection of light in downward directions to illuminate multicolored working surfaces and to inhibit the projection of light in horizontal and other directions where hostile persons may be watching. The projected light intensity is variable by polarizing optical means and is coordinated with the gravity switch and the user's control so that the initial intensity at turn-on of the flashlight occurs at the lowest projected intensity. The lamp array, contained in a removable cartridge, has multiple light emitters selected for color characteristics, for a fast time decay response on turn-off, and for reduced red and infrared energy emissions. Reversal of battery polarity effects dramatic changes in color or intensity of the projected light. A manual control overrides the automatic gravity switch for projection of light in unrestricted directions while a tactile generator warns the user that light is projected in a high risk direction. Modular contruction of the removable cartridge permits selection of optional lighting arrays and accessories.

44 Claims, 4 Drawing Sheets

FLASHLIGHT FOR COVERT APPLICATIONS

BACKGROUND OF THE INVENTION

1. Field of the Invention

The primary field of the invention relates to devices for illumination of limited areas to assist security personnel in performing assigned tasks in hidden or covert situations. Specifically, the flashlight provides enough light in areas of close proximity for the user to perform necessary tasks such as map reading, walking or equipment operation or maintenance while minimizing the possibility of the user being located by hostile observers with their unaided vision or with image intensifiers. In some situations the flashlight may be used as a specialized signaling device.

2. Related Art

Security officers and others are frequently required to conduct surveillance tracking and other operations within eyesight of persons they wish to observe. The task has always been dangerous because, if hostile persons, such as criminals, see the using officer, they may attack him. Presently, it is even more risky because the criminals have access to image intensifiers capable of magnifying very small amounts of light and displaying it on a screen. A variety of these intensifiers are available. Thus previously used covert lighting devices are now unacceptable because they can reveal the officer's location even when the lighting device is set to very low intensities. Other occurrences and features of traditional lighting devices which can reveal the officer's location include the time it takes to adjust the lighting intensity level, the decay time of energy radiation after the power is disconnected, accidental dropping of the lighting device when in the switched-on state and specular reflections of light from nearby surfaces.

A portable lighting device, disclosed in U.S. Pat. No. 4,517,628, granted to applicant, provided means for changing the color of the illumination from incandescent white light to filtered red light for use in blackout conditions; however, that concept is now inadequate as a covert signal light because the radiant energy decay time span is excessive. This device is vulnerable to detection even after it is off because the incandescent filament continues to emit reddish light until substantial cooling has taken place.

U.S. Pat. No. 4,677,533, issued to applicant, et al, discloses a lighting device intended for color discrimination having a combination of colored electronic lamps alone or in combination with an incandescent lamp and with separate electrically variable controls for the adjustment of brilliance of the illumination spectra. With this device specular reflections from illuminated objects or the careless and accidental misaiming of the light may subject the user to a higher probability of detection by hostile observers than is now acceptable for covert operations.

The rheostats taught in U.S. Pat. No. 4,677,533 produce a continuous and slow change in color which is inferior for signaling applications. The rheostat/switch designs are also faulted in an effective covert light which must ideally turn "OFF" instantaneously. This cannot be achieved if the power is turned "OFF" by an intensity control device such as a rheostat which slowly decreases the current and intensity before the actual "OFF" position is reached. The unfiltered incandescent lamp used in some embodiments prevents instantaneous darkening of the device even when the power is instantaneously turned off. Finally, the coordinated rheostat/-switch prevents the device from instantaneously being switched from "OFF" to usable lighting intensity.

Other improvements in lighting devices are disclosed in U.S. Pat. Nos. 4,947,291 and 4,963,798, both issued to applicant. Among the featured improvements of the disclosures are components and circuits for the reduction of radiant energy in the infrared wavelengths, for the synthesis of specific radiation spectral patterns, and for dimming the radiated light and for monitoring battery power.

SUMMARY OF THE INVENTION

A preferred embodiment of the invention is realized in a portable flashlight but the broader application of its principles and features may be realized in various fixed lighting apparatus such as may be permanently mounted in vehicle cockpits and applications supplied with line power in lieu of portable batteries. The several featured improvements of the invention provide limited illumination for a using person who must see to covertly perform assigned tasks without divulging his presence, his location, or the performed task to other persons.

The invention provides one or more light sources in a hooded housing that shapes a beam of emitted radiation so that the direction of the emitted light beam is restricted to illuminate essentially only that surface to be seen by the user. In a preferred embodiment local gravity forces are used, firstly, to inhibit the application of power to the light source lamps by operation of the user's on-off switch to prevent radiation from the lamps of light energy into the volume of space centered along the horizontal planes where other persons or instruments could possibly detect the light and its user; and secondly, to enable the application of power to the light source lamps when the flashlight beam is pointed downward at small angles about the local vertical so as to illuminate only a small local surface area to be seen by the user in the performance of his assigned task.

In preferred embodiments having multiple light sources of different colors assembled in a projecting array, a portion of the light sources that are polarity sensitive, for example light emitting diodes (LEDs) can be assembled in reverse polarity relative to other polarity sensitive light sources of a different color so that a simple reversal of battery polarity in the assembly changes the color of the projected light. Similarly battery polarity reversal on an array containing an incandescent light source not affected by polarity together with polarity sensitive light sources will produce changes in the color of the projected light. The selection of the color of light emitted by a particular choice of polarity is made based upon the needs of the operator of the light, the type of surveillance equipment being used to locate him and the ambient conditions. For example, a bluish light may be desirable to avoid detection by red sensitive detectors while a whitish light would be superior for reading maps. The change from a first desirable color to a second desirable color can be made quickly through the use of a polarity reversing switch or by reversing the batteries. The first and second colors are predetermined by the type and placement of the lamps and they are accurately reproduced each time the operator selects a particular polarity.

As a combination, the invention provides additional polarizer filtering for the dual purposes of dimming adjustment of the projected lighting intensity and for the disproportionate reduction of reflection of light and energy from certain specular surfaces such as plastic overlays upon maps and charts, windshields, polished metals, pieces of glass, etc., or even the housing of the flashlight, itself. In an advanced embodiment of the invention the user's electrical (on-off) power switch is interlocked with the polarizer filter to preclude any "turn-on flare" and misdirection of high intensity light and energy upon initial ignition of the light source or sources. This interlocking of the on-off switch and the polarizer requires the user to gradually reduce the degree of cross polarization to increase the output lighting intensity from a dark or low level to that higher level of intensity which is just sufficient for the user's need in performing his task.

The preferred embodiment of the advanced combination, constituting a user's flashlight for covert applications, requires lamps for light sources that have characteristics of rapid decay time in the emission of light and energy. In other words the visible afterglow, which continues after the power is discontinued but which is detectable either by eye or sensing instrument, is to be reduced to a minimum. In the embodiment having directional control features, as provided, for example, by the gravity switch described above, rapid decay time has increased significance due to the possible reliance of the user upon the automatic turn-off feature of the flashlight when its light projecting axis enters the forbidden spatial zone. For example, if the flashlight were accidentally dropped its probable physical rotation may place the projected beam of residual light and invisible energies into the approximate horizontal plane where detection by the enemy and unintended persons is possible unless rapid time decay is provided. A light shielding hood increases the covert nature of the device because it obscures the lighted face of the device and delays detection until the full intensity of the projected beam is directed into the horizontal plane. This hood induced delay is necessary to permit the gravity switch to de-energize the lamps and for the lamps to decay.

Effective light sources for assembly in this invention, having rapid decay time on removal of power include luminescent lamps of the gaseous discharge, fluorescent, phosphorescent, and electroluminescent types and the family of solid state light emitting diodes. The decay time is also shortened by using a multiplicity of lamps in place of a single bright or hot lamp. The effective decay time for incandescent lamps may be reduced by optical attenuating filtering of the red spectra of the projected beam. In instances where multicolor viewing is a necessity the filtering could be designed to absorb large portions of the red spectrum but still transmit selected wavelengths within the red portion of the spectrum. The transmitted red energy would be helpful in identifying the color of red objects. Since the bulk of red energy would be absorbed by the filter, the decay time would be shortened and since selected energy in the red portion of the spectrum is transmitted, the color of red objects would be identifiable. Combinations of different types and colors of lighting sources may be assembled in removable and interchangeable modular packages.

In another embodiment, the gravity switch is used to activate a tactile or audible warning signal to alert the operator when light energy is being projected into a forbidden direction or spatial zone such as the horizontal plane.

An object of this invention is to provide a lighting device for persons engaged in covert activities in the performance of assigned tasks with the lighting device having features that prevent the beam of emitted light from being inadvertently directed into the space along the horizontal plane that may contain hostile observers having either natural or enhanced vision.

Another objective is to provide a lighting device for support of users while walking or performing other tasks which is effective in maintaining the covertness of its user should the device be accidentally dropped whereby its emitted light beam may rotate in space.

Another objective of the invention is to provide a covert lighting device that provides adjustable controls with recordable settings for its lighting intensity and/or color prior to specific instances of use for projecting exactly the required illumination in the minimum turn-on time span, and positive control and features for extinguishing the emitted light substantially instantaneously.

Another object of the invention is to provide improved security through polarity sensitive light sources in a circuit that effects a step change in color of the projected light upon reversal of the electrical polarity in the assembled device.

Another object of the invention is to reduce the amount of external radiation of light emitted to create the illumination needed by the user in adequately performing various assigned tasks.

It is another object of this invention to create a lighting device which has its emitted spectral energy filtered to create a balance between the objectives of rapid decay time and multicolor viewing.

Another object of this invention is a lighting device that is normally operable by the user only when its light beam is directed downward at small angles about the vertical direction sufficient only to illuminate small local areas thereby concealing the location of the user to hostile observers.

It is another objective of this invention to use gravitational forces to operate a switch to prevent the radiant energy emitted from the lighting device from being projected towards hostile observers. It is a further objective to use a light shielding hood extending from the exit aperture of its device to prevent the lighted exit aperture from being observed during the time span that is required for the gravity switch to operate and lamps to extinguish.

Another objective of this invention is to provide a lighting device that can be operated so that emitted light and radiant energy which may strike specular surfaces will be attenuated and reflections to the eye of the user and to the sensing elements of image intensifiers of hostile observers may be reduced.

Another objective of this invention is to provide controls, responsive to the user, whereby polarized light projected from the device can be adjusted to minimize specular reflections from nearby illuminated objects and surfaces.

Another objective of the invention is to provide a special signaling mode through emergency controls, responsive to the user, for pulsed light transmissions of rapid rise and decay times in directions chosen by the user for clearly defined signaling with lower probability of detection through image intensifiers located out of the chosen directional path.

A still further objective of the invention is to provide a tactile or audible warning to the user when holding the activated lighting device in a prohibited orientation.

Other objects, features, and advantages of the invention may become apparent from the description in connection with the accompanying drawings of preferred embodiments.

BRIEF DESCRIPTION OF THE DRAWINGS

The invention is described with reference to accompanying drawings, in which.

DETAILED DESCRIPTION OF THE INVENTION

Figure 1:
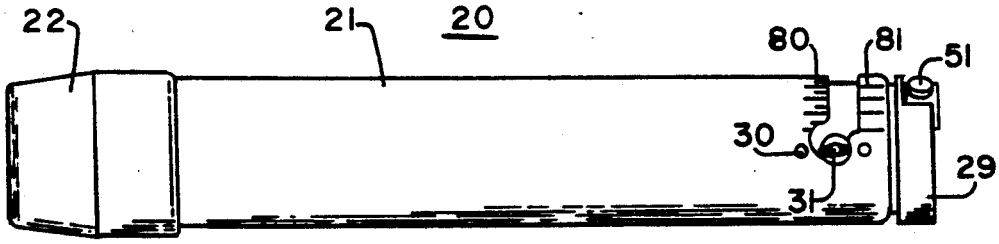
FIG. 1 is a side elevation view of a tubular portable flashlight in accordance with the invention showing the operator's manual controls in the light-off and minimum intensity positions.
Figure 2:
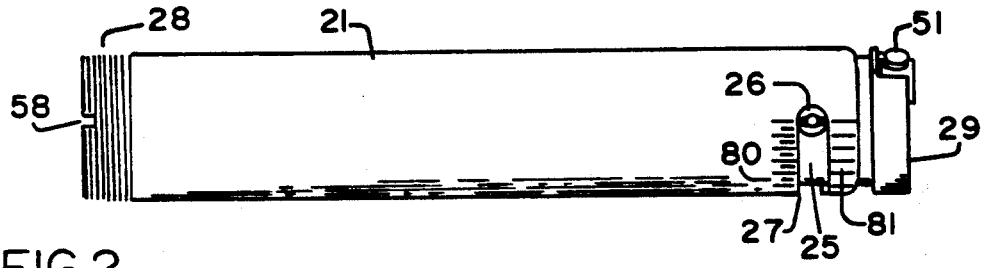
FIG. 2 is a side elevation view of the portable flashlight showing the bezel removed and the operator's controls in the automatic gravity activating mode with the polarizer dimmer adjusted for full lighting intensity.
Figure 3:
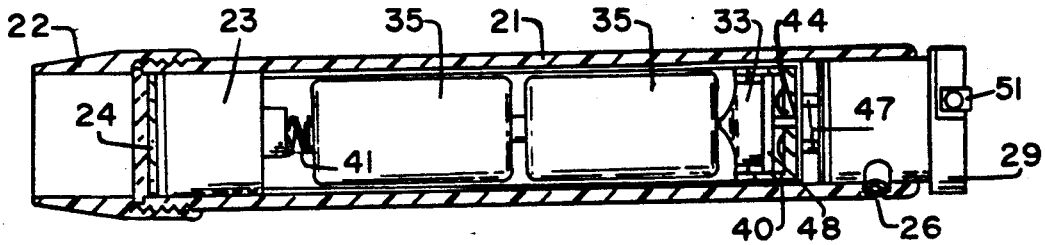
FIG. 3 is a longitudinal cross-sectional view of the portable flashlight showing the removable cartridge and major internal subassemblies.

Referring now to FIGS. 1-3 there is illustrated a preferred embodiment of the invention in a portable flashlight 20 contained in a tubular case 21, having at one end a removable hood or bezel 22 for securing a lamp module 23 and optics 24 and for shielding and restricting the projected light into a beam of illumination. The removable hood 22 is attached to the case 21 by matched machined threads 28 seen in FIGS. 2 and 3. At the opposite end of the case 21 a removable cartridge subassembly 25 is illustrated as inserted within the casing 21 and as being manually rotatable by the operator through angles limited by the cartridge lock pin 26 contained within the slot 27 in the case 21. The relative rotational position of the cartridge assembly 25 with respect to the case 21 is identified by graduated indicators 80 on the case 21 adjacent to the slot 27 and adjustable lock pin 26. The indicators of the coarse scale 81 allow adjustments of lighting intensity by the user's touch.

Figure 4:
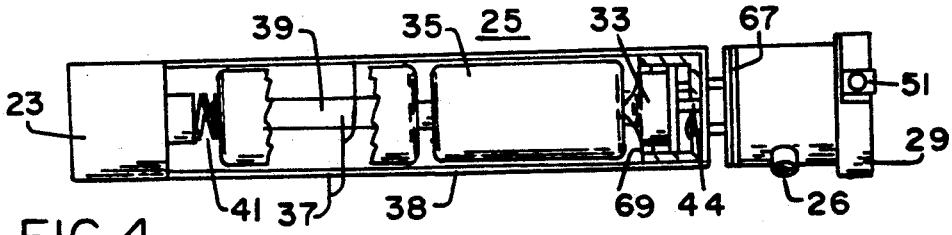
FIG. 4 is a plan view of a fully assembled lighting cartridge with batteries and an interchangeable light source array.

In normal covert usage of the flashlight 20, the insertable cartridge 25, illustrated in FIG. 4 and seen in FIG. 3, is rotated by the operator's control cap 29 to obtain the normal light-off condition when case markers 30 and cartridge marker 31 are aligned as illustrated in FIG. 1. Rotation of the cartridge subassembly 25 through the range of the slot 27 effects a continuous adjustment, as hereafter described, of the intensity of the projected light from minimum intensity upon departing from marker 30, 31 alignment to the highest intensity at the extreme position of the lock pin 26 within the slot 27. Thus rotation of the cartridge 25 achieves a dimming function for the flashlight 20 providing assurance that at normal turn-on of the light excessive light intensity (which might alert observers hostile to the user) is avoided. After turn-on the user rotates the cartridge 25 bringing the intensity upon the illuminated surface up to a satisfactory level.

Polarizing the light emitted from the flashlight substantially improves its covert characteristics. In a normal flashlight, the light emitted could divulge its user's location by reflecting off nearby specular surfaces. By placing a single polarizing filter on the preferred embodiment, we emit a polarized light. Depending upon the plane of polarization, the light is not reflected as efficiently from specular surfaces as nonpolarized light and because of this, the polarized light design is less likely to divulge its operator's presence. The efficiency of the specular reflection depends upon the degree of polarization of the emitted light and the polarizing characteristics of the specular surface. By placing a second polarizing filter in the flashlight and rotating this filter with respect to the first filter, we can control the intensity of the light emitted from the flashlight. Furthermore, we simultaneously dim the specular reflections. This specular dimming is disproportionally greater than the dimming of the light's intensity because the intensity of the reflected light is reduced by both the reduction in the light's intensity and the increase in polarization of the emitted light. Thus the percentage of dimming for the reflections is greater than that of the emitted light because a larger percentage of the emitted light is cross polarized with the specular surface at low intensities. This specular dimming becomes more effective at the low light levels which are the intensities needed for night vision. Since the polarizing filters are less effective in polarizing the light at longer wavelengths, the covert nature of the lighting device is further improved if the percentage of energy radiated in the red wavelengths is minimized.

Figure 12:
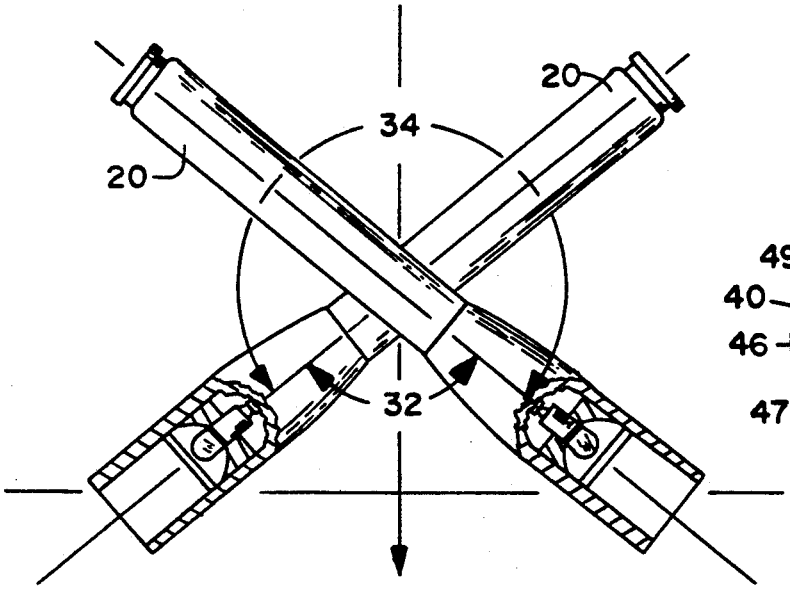
FIG. 12 illustrates, in two dimensions, automatic gravity control of the projected illumination from the flashlight, limited to small angles about the vertical direction.
Figure 13:
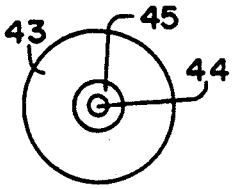
FIG. 13 is an end view of a typical gravity switch illustrating electrical circuit connecting surfaces.

Operation of the flashlight 20 by the user, in the normal sense, requires downward projection of light to illuminate surfaces existing in the bounds of a small zone 32 surrounding the vertical direction within an acute included angle, as illustrated in FIG. 12. In normal operation of the flashlight 20, the projection of light is extinguished automatically by a gravity switch 33, FIGS. 3-4 and 15-17. The gravity switch 33 interrupts the circuit from the batteries 35 if and when the flashlight 20 is aimed, either intentionally or accidentally, into the forbidden zone 34, FIG. 12, where hostile observers may be located. However, for an emergency signalling mode of operation, the user may aim the flashlight 20 into a selected horizontal direction with the intensity control of the lock pin 26 set by touch at a coarse scale marker 81, then operate the override switch 51 to the "on" position 53, FIG. 6, for bypassing the automatic gravity controlled mode.

The hood 22 can be designed to form an opaque hood surrounding and extending beyond the light emitting aperture at the front of the flashlight. This hood when used in concert with the gravity switch creates a flashlight which remains covert even under extreme conditions. FIG. 12 shows the flashlight at the angular orientation at which the gravity switch just turns "off." A hostile observer in the horizontal plane would theoretically not see the projected beam or the lighted face of the flashlight. However, in a real situation such as when its operator stumbles, the flashlight may be moving. Time would be required for the gravity switch to de-energize the lamps and time would be required for the lamps to decay to the visual "off" condition. If the hood in FIG. 12 were longer, it would provide that needed time and the covert flashlight would be visually extinguished by the time it rotated into a position which would compromise its location. To accommodate different types of light source modules 23 interchangeable hoods 22 are provided to confine the projected light within a beamwidth of less than seventy degrees.

Thus with the gravity switch shut-off operating angle set at less than forty five degrees from the downward vertical and with a half beamwidth design of the projected light less than thirty five degrees any upward pitch of the flashlight 20 will automatically extinguish the lamp or lamps 62-64, having fast decay characteristics, in less than eighty degrees from the downward vertical and before energy is radiated along horizontal directions. For an established gravity switch shut-off operating angle, alternate light source modules 23 having the shortest decay time can accommodate hoods 22 yielding the larger projected light beamwidth while source modules 23 of long decay time characteristics require hoods 22 yielding smaller projected light beamwidths to preclude radiation of energy along horizontal directions.

The dimming slot 27 of the case 21 is provided with a gravity switch disabling cam 36. Rotation of the cartridge 25, by the control cap 29, to place the cartridge lock pin 26 upon the disabling cam 36 region of the dimming slot 27 requires the user to push the control cap 29 deeper within the flashlight case 21.

The insertable and rotatable cartridge 25, seen within the case 21 in FIG. 3, is illustrated separately in FIG. 4. In addition to the control cap 29, the cartridge 25 is formed by an electrically conducting cage 37 consisting of a wraparound conducting strut 38 and a short conducting strut 39 arranged at right angles thereto for an open sided cage into which removable batteries 35 may be inserted and removed as operations and servicing requires. Interchangeable lamp modules 23 are assembled to the end of the cartridge cage 37 opposite to the control cap 29. At the end of the cage 37 nearest the control cap 29, a gravity switch retaining cup 40 is enclosed within the conducting struts 38, 39 of the cage 37. A battery spring 41 provides an electrical circuit between the batteries 35 and a contact plate 42 of the lamp module 23. When the lock pin 26 of the control cap 29 is placed by the user in the disabling cam 36 of the case 21, FIG. 1, the compression spring 41 situated between the battery 35 and light module 23 is compressed. In its compressed state, spring 41 exerts a counter force through battery 35, gravity switch 33, cap screws 47 and control cap 29. This force secures the flashlight 20 in a disabled gravity operating mode by retaining the lock pin 26 within the cam 36.

A typical gravity activating electrical switch 33, illustrated in FIGS. 3, 4, 13, 15, and 16 has an electrically conducting case 43, a post terminal 44, and a terminal feed through insulator 45. The post terminal 44 projects coaxially into the concavously arched inner region formed in the opposing end wall of the cylindrical conducting case 43. The case 43 contains a small volume of a conducting liquid, or other equivalent vehicle, for bridging the gap between the post terminal 44 and the conducting case 43 to close the electrical circuit at a defined downward pitch angle of the flashlight 20, symmetrically for all angles in azimuth or roll of the flashlight about its longitudinal axis, and for opening the electrical circuit at substantially the same defined downward pitch angle when the longitudinal axis of the flashlight 20 is elevated toward the horizontal direction, thus defining an acceptable spatial zone for covert operation of the flashlight 20. In the cartridge subassembly 25, the gravity switch case 43 contacts a terminal of a battery 35. The gravity switch post 44 projects into and through a passageway 46 in the retaining cup 40, which is an insulator, to make contact (for automatic gravity control of the flashlight 20) with the electrically conducting wraparound strut 38 to complete an electrical circuit to the lamp module 23. The gravity switch 33 is captured within the retaining cup 40 by a ring 69 tightly fitted within the cup 40 and loosely fitted about the gravity switch case 43, FIGS. 3 and 4.

Figure 14:
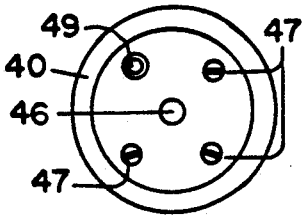
FIG. 14 is an end view into the gravity switch retaining cup.
Figure 15:
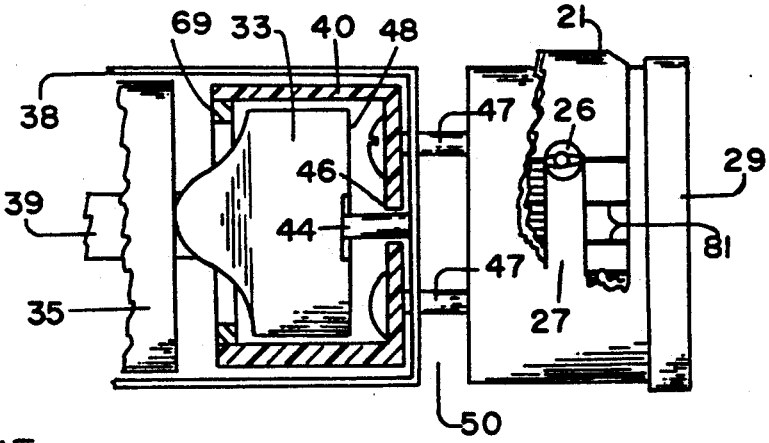
FIG. 15 is an enlarged schematic view showing the gravity mode of flashlight control in operating status.
Figure 16:
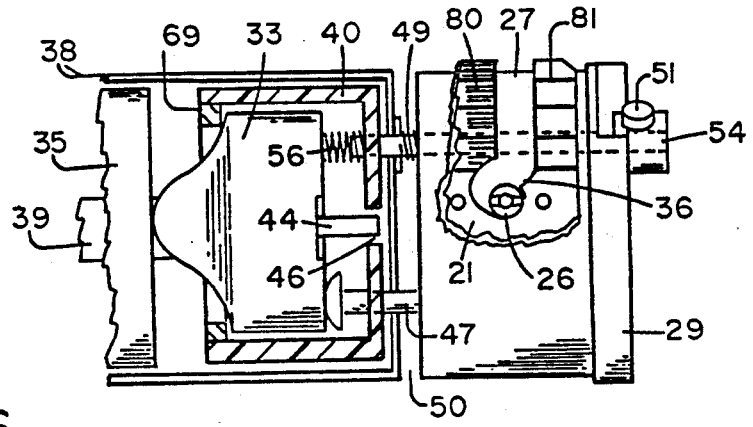
FIG. 16 is an enlarged schematic view showing the gravity mode of flashlight control in the off status.

The control cap 29 is mechanically tied to the gravity switch retaining cup 40 by at least three cap screws 47, FIGS. 14-16, which also serve as push rods against the flat surface 48 of the gravity switch case 43. Compression spring 41 maintains a force tending to separate the control cap 29 from the gravity switch retaining cup 40 a small distance 50 determined by the length of the three cap screws 47. When the control cap 29 is rotated and pushed inward in the flashlight case 21 to rest the lock pin 26 in the gravity mode "off" cam 36 the three cap screws 47 make contact with the flat surface 48 of the gravity switch 33 to effect a compression of the battery spring 41. Thus the batteries 35 and the gravity switch 33 move in unison toward the lamp module 23 within the cartridge cage 37 a short distance sufficient for the gravity switch post terminal 44 to break its contact with the wraparound strut 38, thereby opening the electrical circuit from the batteries 35 to the lamp module 23 to turn the flashlight 20 off when the user's selector control 51 is set for automatic gravity controlled operation.

Figure 5:
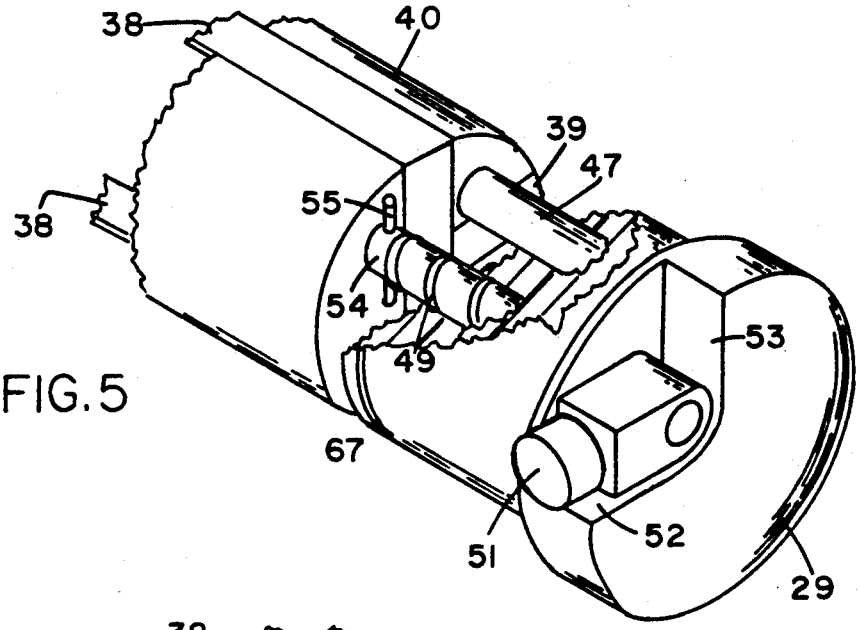
FIG. 5 is a cutaway illustration of the operator's controls showing the manual override switch in the automatic gravity activating position.
Figure 6:
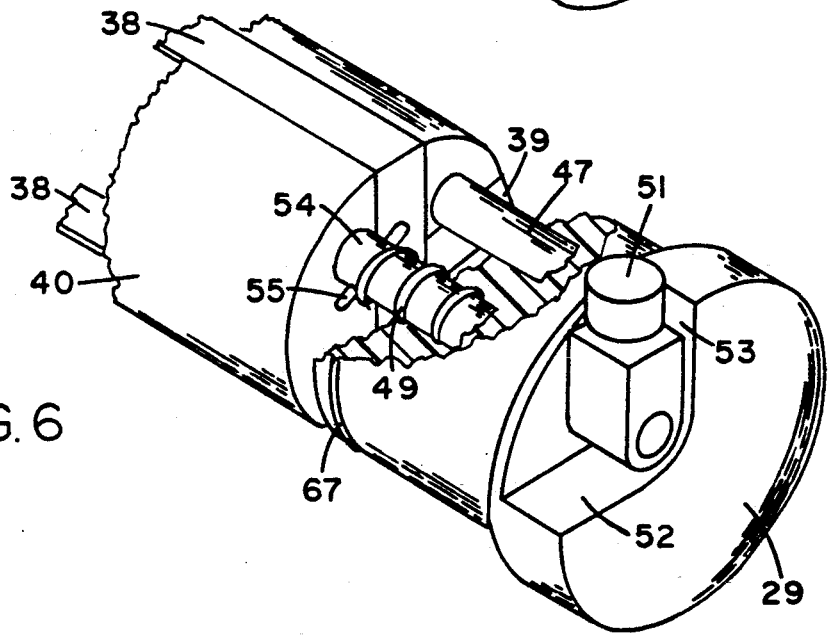
FIG. 6 is a cut away illustration of the operator's controls showing the manual override switch in the full "on" position overriding the gravity activating mode.

The flashlight selector control 51 provides to the user an override function whereby light may be projected at any aiming angle of the flashlight 20 irrespective of the status of the gravity switch 33. It is expected that use of the override function may be operationally restricted to emergency and special field situations such as for signaling friendly forces, or when the user is located within shielding obstructions to hostile viewers. The gravity operating position 52 of the selector control 51 is shown in FIG. 5. A rotatable shaft 54 extends from the selector control 51 through the control cap 29 and retaining spring 49 into the closed end of the gravity switch retaining cup 40. Spring 49 is secured upon the shaft 54 by a contact pin 55 which passes diametrically through the shaft 54 at the surface of the gravity switch cup 40. FIG. 6 shows the selector control 51 and shaft 54 rotated to the override position 53, typically ninety degrees, to bring the contact pin 55 upon the wraparound strut 38 of the flashlight electrical circuit. Positioned inside the gravity switch cup 40, FIGS. 14–16, the override electrical circuit is completed by the override conducting spring 56 which, in both gravity and override modes of operation, bridges from the flat surface 48 of the gravity switch case 43 to the override shaft 54.

Figure 8:
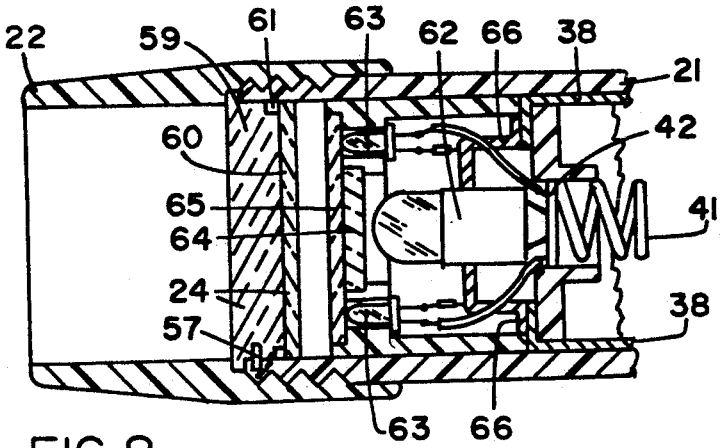
FIG. 8 is a partial cross-sectioned view illustrating the relationship of multiple light sources with polarizing and filtering optics with the tubular housing and bezel.

Secured in fixed relation to the flashlight case 21, by a locator pin 57 which fits in a matched notch 58 in the bezel threads 28 of the case 21, is the projecting optics 24, FIGS. 3 and 8. The projecting optical subassembly 24 includes the outer lens 59 and an optical polarizer 60 which are cemented into a unit having an O-ring 61 about their circumference to prevent entry of foreign substances within the flashlight case 21, FIG. 8.

Figure 9:
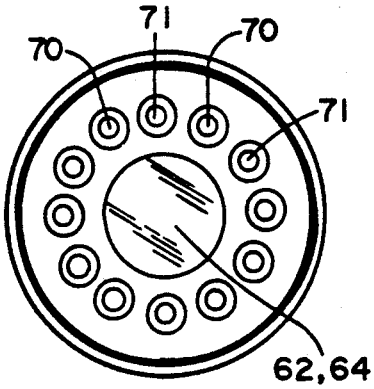
FIG. 9 is an end elevation view of a typical lighting array showing an incandescent lamp with multiple colored LED light sources.

A variety of interchangeable lamp modules 23 are considered within the scope of the invention, however, a preferred module 23, FIGS. 8 and 9, contains an array of multiple light sources including an incandescent lamp 62 and multiple light emitting diode (LED) lamps 63 which radiate energy at one or more colors of the visible spectra. An optical filter 64, typically in the blue spectra, absorbs the red and infrared energies of the incandescent radiation. The lamp module 23 is capped by a second polarizer 65. Rotation of the cartridge subassembly 25 with its lamp module 23 and module polarizer 65, fixed thereto and rotating therewith, relative to the flashlight case 21 and fixed polarizer 60 from a condition of cross polarization to parallel polarization increases the intensity of the projected light from its lowest intensity to the highest intensity.

The electrical circuit through the lamp module 23, FIG. is contained in the battery spring 41, the contact plate 42, the lamp circuit (filament, or junction, etc.) and the array manifold 66, which connects to conducting struts 38, 39 of the cartridge cage.

For insertion in or removal of the cartridge subassembly from the flashlight case 21, the spring loaded lock pin 26 is pushed radially inward within the circumference of the control cap 29. The control cap 29 is also provided with an O-ring 67 to prevent entry of foreign substances within the flashlight 20.

Figure 17:
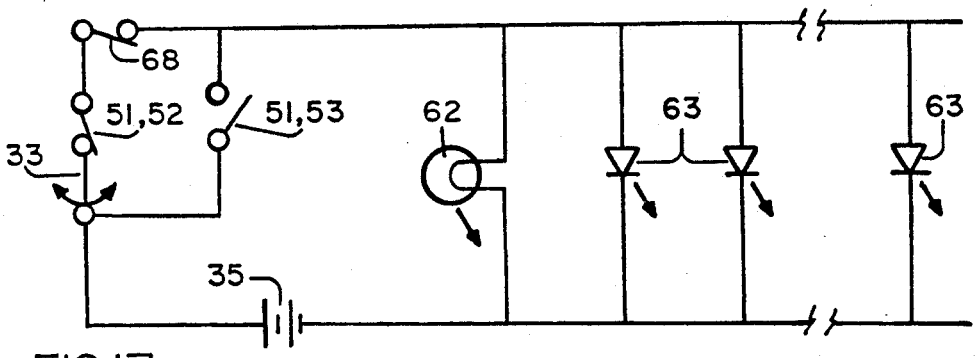
FIG. 17 is a basic electrical circuit for multiple light emitting sources.
Figure 18:
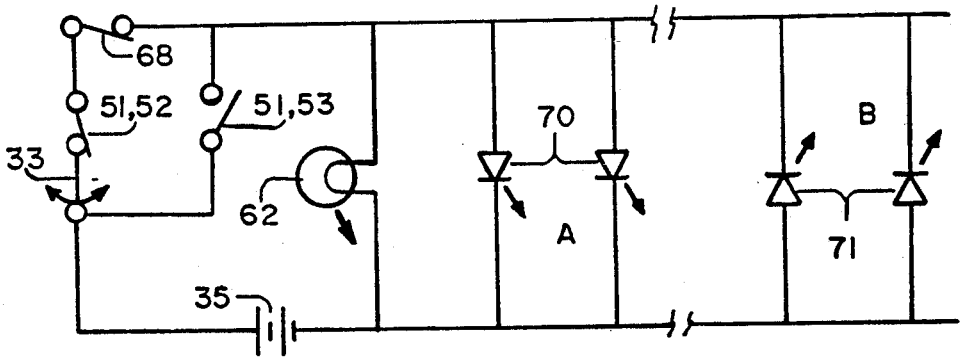
FIG. 18 is a battery polarity sensitive electrical circuit for switching intensity and/or color and intensity of the projected light.
Figure 19:
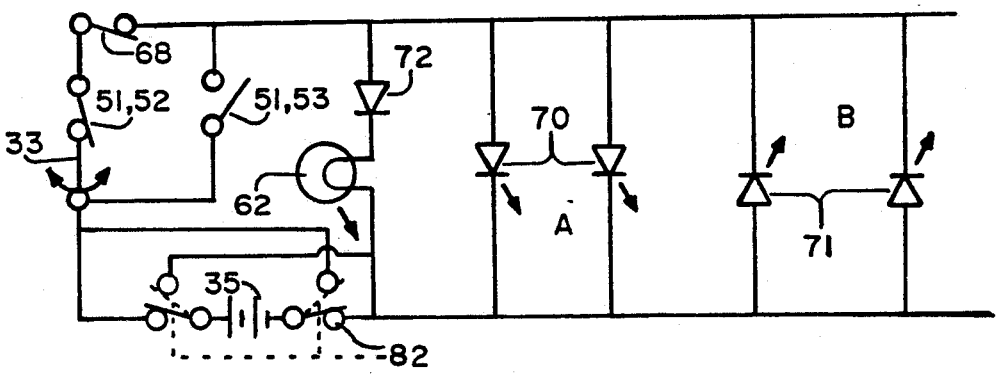
FIG. 19 is an alternative battery polarity sensitive electrical circuit for switching intensity and/or color and intensity of the projected light.

Typical electrical schematics for secure flashlights 20 are illustrated in FIGS. 17–19. A basic electrical schematic is illustrated in FIG. 17 showing a battery 35 powered flashlight 20 having at least one lamp but preferably an array of multiple lamps including for example an incandescent lamp 62 and a multiplicity of light emitting diodes (LEDs) 63 which may be selected to provide light in more than one color of the visible spectra. The LEDs 63 are arranged typically in parallel with the incandescent filament 62. The electrical circuit flows from the batteries 35 to the lamps 62, 63 through a circuit of the gravity activated switch 33 in series with a manual inhibiting circuit 68 which is mechanically implemented by the contact between the gravity switch post terminal 44 and the conducting wraparound strut 38 of the cartridge cage 37. The inhibiting circuit 68 is opened by the user when the cartridge lock pin 26 is placed in the gravity-off cam 36 of the flashlight case 21. The user's override switch 51 shunts the series circuit of the gravity switch 33 and the contact between the post terminal 44 and the conducting strut 38 to provide, when selected by the user, constant power to the lamp module 23 (62–63). Mechanically the override switch 51 is embodied in the override spring 56, the rotatable shaft 54, the contact pin 55, and the conducting strut 38.

Figure 10:
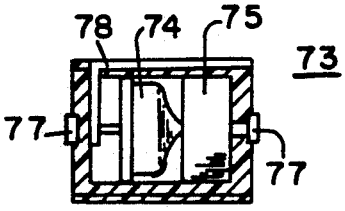
FIG. 10 is a cutaway view of an insertable tactile warning module.
Figure 11:
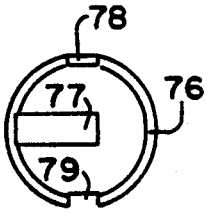
FIG. 11 is an end elevation view of the insertable tactile module.

The user of the flashlight 20 could inadvertently subject himself to detection should he unintentionally place the selector control 51 in the override position 53, thinking he had rotated the control cap 29 to activate the automatic gravity control mode. In advanced models of the flashlight 20 a tactile warning to the user can be provided. To provide vibration for stimulation of the user's sense of touch a tactile warning subsystem may be permanently incorporated or provided as desired by an insertable tactile module 73 designed to fit within the cage 37 of the cartridge 25 subassembly, as shown, for example in FIG. 7. The tactile module 73, FIGS. 10 and 11, contains a secondary automatic gravity actuated switch 74 and an electrical vibrator 75 which may be of the electronic, unbalanced rotating mass, or equivalent types. The insertable tactile module 73 has an insulating casing 76, an end-to-end bypass electrical conductor 77 for supply of electrical power both to the tactile module 73 and the illumination subsystem 23 by contact with the battery 35 and spring terminal 41 of the illumination subsystem 23. For its own electrical power supply a return conductor 78 extends from the tactile gravity switch 74 through the casing 76 to make contact with a conducting strut 38 of the cartridge cage 37 for return to the battery 35. Slotted keyways 79 extend longitudinally in the tactile casing 76 at matched locations for receiving therein the wraparound 38 and short 39 struts of the cartridge cage 37 to maintain electrical circuit continuity for the illumination subassembly 23 and the tactile module 73. In operation of the flashlight 20, the user may place the selector control 51 in the override position 53, FIG. 6, to effect electrical bypass of the illumination gravity switch 33 to activate the illumination subassembly 23 continuously regardless of physical orientation, and likewise to supply power continuously to the tactile module 73. If the flashlight 20 is pointed vertically downward the tactile gravity switch 74 interrupts the circuit to the tactile vibrator 75, however, if the flashlight 20 is aimed to project light upward or horizontally, FIG. 12, the tactile vibrator 75 is activated to warn the user. The tactile warning module 73 is ineffective if the user's selector control 51 is in the gravity position 52, FIG. 5, for automatic gravity control of the illumination subassembly 23.

For covert operations requiring a source of light, among the objectives is a requirement for the shortest possible rise and decay times for projection of visible light and any infrared energy upon application and removal of electrical power, respectively. The objective is achieved by this invention in the combination of a thermally insulated and opaque flashlight case 21 and bezel 22, the red and infrared attenuating filter 64 for the incandescent lamp 62, the LED lamps 63 at selected colors, and the bezel and lamp module polarizers 60 and 64 for intensity adjustment. The provision for interchangeable lamp modules 23 allows substitution of alternate lamp sources of solid state electroluminescent and gaseous discharge types for the incandescent and/or LED lamps for unique applications.

Figure 7:
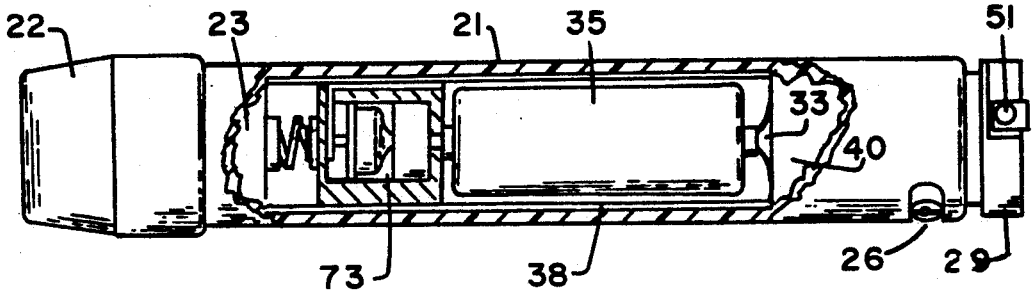
FIG. 7 is a partial cut away view of the flashlight with the cartridge inserted in the tubular housing, and showing a battery in reversed polarity assembly for a change of color of projected light, and the insertion of a tactile warning generator.

Referring to FIGS. 3, 4 and 7 it is seen that the batteries 35 may be assembled in the cartridge 25 in either polarity. In field operations the user of the flashlight 20 may dramatically alter the characteristics of the projected light in intensity and/or color by reversing the polarity of the batteries 35 in the electrical circuit.

In the basic circuit of FIG. 17, with battery 35 polarity as illustrated, the incandescent lamp 62 and all of the LEDs 63 are functional to provide full intensity and a specific spectrum of visible colors of light. Upon reversal of battery 35 polarity only the incandescent remains functional to provide a lower intensity and also an altered spectrum of colors of the projected light. If the incandescent lamp has a blue or red absorbing filter and the LEDs are red, the operator has the choice of a blue projected beam—superior for covert noncolor viewing—or a whitish beam—superior for multicolor covert viewing. The alternate embodiment illustrated by the circuit of FIG. 18 has a lamp module 23 containing an incandescent lamp 62 in combination with a first array 70 of LEDs for emitting a color spectra "A" of light and with a second array 71 of LEDs, connected for reversed battery 35 polarity, for emitting a color spectra "B" of light. In the circuit of FIG. 18 a reversal of battery 35 polarity, assuming the "A" array of LEDs 70 to possess comparable light intensity of the "B" array of LEDs 71, will yield projected light from the flashlight 20 substantially the same in intensity levels but dramatically different in color characteristics. In the alternate embodiment illustrated by FIG. 19 the lamp module 23 has an added diode 72 in series with the incandescent filament 62 making the series combination polarity sensitive, shunted by the parallel LED arrays 70, 71. Reversal of battery 35 polarity in FIG. 19, yields the "B" array 71 of LEDs operative for a major change of both the intensity and color of the projected light. The reversal of battery 35 polarity may be effected by inverted direction of assembly in the cartridge 25 or by a polarity reversing switch 82 as typically illustrated in FIG. 19.

This invention may be embodied in other specific forms without deviating from its concepts and essential characteristics. The preferred embodiment disclosed above is therefore to be considered in all respects as illustrative and not limiting of the scope of the invention indicated by the appended claims.

Having described the invention, I claim:

1. A device, operative on the application of electrical power, for the projection of light in a directed beam, wherein the improvement comprises:

a) an illumination subassembly, responsive to said application of electrical power, comprising at least one light source; and b) a symmetrical gravity actuated electrical switch for automatically controlling said application of power to enable said projection of beamed light into a defined acceptable spatial zone about the downward vertical direction and to inhibit said projection of beamed light in all remaining space outside of said acceptable spatial zone said gravity switch symmetrically operative at any angle of rotation of said device about the longitudinal axis of said illumination subassembly.

2. A device, as recited in claim 1, wherein said defined acceptable spatial zone comprises:

a) a volume of space about the apparent local downward vertical direction, further comprising a field of illumination determined by an acute angle for the beamwidth of said device; and b) said volume of space comprises a portion of the hemispherical volume located below the horizontal plane containing the center of gravity of said device.

3. A device, operative on the application of electrical power, for the projection of light in a directed beam, wherein the improvement comprises:

a) an illumination subassembly, responsive to said application of electrical power, comprising at least one light source;

b) a reversible gravity actuated switch for automatically controlling said application of electrical power to said illumination subassembly to enable said projection of beamed light into a defined acceptable spatial zone about the downward vertical direction and to inhibit said projection of beamed light in all remaining space outside of said acceptable spatial zone, said gravity actuated switch comprising:

a sealed case; and a conductive liquid for enclosure in said sealed case, said conductive liquid automatically responsive in movement within said case to the force of gravity, for operating said electrical switch to enable said application of electrical power for projection of said light beam in said defined acceptable spatial zone about said vertical direction, and for operating said electrical switch to inhibit said application of electrical power for extinguishing said light beam before rotation of said light beam upward forty-five degrees from said downward vertical direction.

4. A device, as recited in claim 1 or 3, wherein the improvement further comprises:

a continuously variable control, responsive to said attending user of said device, for reciprocal adjustment of the luminous intensity of said beamed light projected from said device.

5. A device, as recited in claim 4, wherein said variable control of luminous intensity of said beamed light comprises:

a) a rotatable optical filter interposed in the exit aperture of said device for the polarization of said beamed light;

b) a stationary optical filter interposed in the exit aperture of said device for the successive polarization of said beamed light; and c) means for continuous variable adjustment, responsive to said attending user, of said rotatable polarizing filter to effect a variable differential polarization of said projected light beam in a range between parallel planes of polarization and crossed planes of polarization yielding thereby said variable adjustment of the luminous intensity of said projected light beam between maximum and minimum intensities, respectively.

6. A device, as recited in claim 5, wherein the improvement still further comprises:

a) means for securing operational registry between said polarizing optical filters, differentially adjusted for said crossed planes of polarization, and said lock-out means for said gravity actuated switch as placed in said non-operative off-status, for initiating said beamed light at said minimum level of luminous intensity from which said attending user may increase said luminous intensity to said maximum level obtainable at said differential adjustment of said polarizing filters for parallel planes of polarization of said projected light beam.

7. A device as recited in claim 5, wherein the improvement still further comprises:

a) a graduated scale of indicators for dividing the range of control of said variable luminous intensity level, said indicators usable by said attendant for fine visual adjustments of said intensity level and for coarse adjustments by touch sensing in darkened situations.

8. A device, as recited in claim 2 or 3, wherein the improvement further comprises:

a) a housing for said illumination subassembly to enable the projection of a directed beam of light with a desired angular beamwidth; and b) a gravity actuated electrical switch, with ON and OFF modes determined by the shutoff angle of said switch, for application of power to said illumination subassembly whenever said device is directed in a downward vertical direction, and for sustaining said application of power until said device is rotated away from said downward vertical direction through an angle equal to said shutoff angle, wherein the sum of said shutoff angle and one half angular beamwidth of said directed beam of light is less than eighty degrees.

9. A device, as recited in claim 8, wherein the improvement still further comprises:

a) a tubular opaque hood for shielding the lighted face and reflector of said illumination subassembly to prevent viewing of any portion of said lighted face and reflector unless an observer in front of said device is located within an acute viewing angle of the longitudinal axis of said device.

10. A device, as recited in claim 1 or 3, wherein the improvement still further comprises:

a) an electrical override switch, manually operable by said attending user, comprising electrical contacts with means for closure thereof for an electrical circuit in parallel with said gravity actuated electrical switch for an override application of power to said illumination subassembly irrespective of spatial orientation of said device.

11. A device, as recited in claim 1 or 3, wherein the improvement further comprises:

a) means for automatically reducing the decay time span for extinguishing said projection of light, said light preset at any operable luminous level when said electrical power is disconnected from said illumination subassembly.

12. A device, as recited in claim 10, wherein said override switch further comprises:

a) a helical spring having a first end thereof in conducting contact with the casing terminal of said gravity switch and a second end thereof in conducting contact with an enclosed first end of a conducting override shaft;

b) an exposed second end of said override shaft for operational access by said attending user;

c) a conducting bar transversely affixed to said override shaft at a location in proximity to said first override shaft end; and d) a wraparound strut of a battery holding cage, offset from the longitudinal axis of said override shaft a distance that is bridged by said transverse bar when said override shaft is rotated, by said attending user, into the gravity switch bypass mode thus forming an electrical circuit from a battery to said illumination subassembly.

13. A device, as recited in claim 1, wherein said gravity actuated switch comprises:

a) a sealed conducting case in a cylindrical configuration further comprising a concavously arched inner region symmetrically formed in a first end wall of said case;

b) a conducting post terminal coaxially projecting into said concavously arched inner region of said first end wall;

c) an insulator for isolating said conducting post terminal from said sealed case;

d) a symmetrical gap between said post and the inner wall of said sealed case;

e) a conducting liquid in the cavity of said sealed case in sufficient quantity to bridge the gap between said post terminal and the inner surface of said arched inner region of said case when said light beam is directed downward, said quantity of said conductive liquid being insufficient for bridging said gap when said central axis is aimed upward from said vertical direction in excess of forty five degrees; and f) means for unobstructed movement of said conducting liquid within said sealed case between said OFF and ON modes to effect automatic switch operation at the boundary of said acceptable spatial zone, automatically responsive to the forces of gravity.

14. A device, operative on the application of electrical power, for the projection of light and radiant energy in a directed beam, wherein the improvement comprises:

a) an illumination subassembly, responsive to said application of electrical power, comprising at least one lamp;

b) an alarm subassembly for alerting an attending user that said beamed light is projected into a forbidden spatial zone, outside of an acceptable spatial zone comprising said apparent local downward vertical direction;

c) a manually operable electrical switch, responsive to said attending user, comprising electrical contacts with means for closure of an electrical circuit to energize said lamp and said alarm subassembly; and d) an automatic gravity actuated electrical switch that de-energizes said alarm subassembly when said beamed light is projected into said acceptable spatial zone.

15. A device as cited in claim 14 wherein said alarm subassembly comprises an audible signaling device.

16. A device as cited in claim 14 wherein said alarm subassembly comprises a tactile signaling device.

17. A device, operative on the application of electrical power, for the projection of light in a directed beam, wherein the improvement comprises:

a) an illumination subassembly, responsive to said application of electrical power, comprising at least one lamp, b) means for automatically reducing the decay time span for extinguishing the projected light, said projected light preset at any operable luminous intensity level, when said electrical power is disconnected from said illumination subassembly; and c) a tubular opaque hood for shielding said illumination subassembly to prevent viewing of said illumination subassembly by an observer located outside of a thirty five degree angle measured from the longitudinal axis of said directed beam.

18. A device, as recited in claim 17, wherein the improvement further comprises:

a) a continuously variable controller for the level of luminous intensity of said projected light.

19. A device, as recited in claim 18, wherein the improvement still further comprises:

a) a graduated scale of indicators for dividing the range of control of said luminous intensity level, said scale usable by an attendant for fine visual adjustments and for coarse adjustments by touch sensing in darkened situations.

20. A device, as recited in claim 17, wherein the improvement further comprises:

a) at least one switch that is automatically operable, responsive to physical orientation of said device, for "On" or "Off" application of said electrical power independently of the adjusted position of said luminous intensity controller.

21. A device, as recited in claim 17, wherein said means for reducing the decay time span comprises:

a) at least one light emitting diode lamp in said illumination subassembly.

22. A device, as recited in claim 17, wherein said means for reducing the decay time span comprises:

a) said illumination subassembly further comprising:
an incandescent lamp; and
a red light absorbing filter interposed between said incandescent lamp and an exit aperture of said device for said directed beam.

23. A device, as recited in claim 17, wherein said means for reducing the decay time span comprises:

a) said illumination subassembly further comprising a multiplicity of lamps.

24. A device, as recited in claim 17, wherein said means for reducing the decay time span comprises:

a) at least one electroluminescent lamp in said illumination subassembly.

25. A device, as recited in claim 17, wherein the improvement further comprises:

a) a control system, operable by an attending user, for a coordinated dimming of said directed beam and the disconnection of said electrical power for extinguishing the projection of light from said device.

26. A device, as recited in claim 25, wherein said control system comprises:

a) first and second polarizing filters, operative differentially by said user, between parallel and cross planes of polarization of said directed beam; and b) an on-off switch for said electrical power keyed to be operative at said cross plane polarization at the minimum level of luminous intensity of said directed beam.

27. A device, as recited in claims 1, 14, or 17, wherein said light beam comprises:

a) a concentration of at least 75 percent of the energy within the 620–700 nanometer bandwidth is in a 40 nanometer bandwidth for red object viewing; and b) a concentration of at least 85 percent of the energy within the 380–700 nanometer bandwidth is within the 380–600 nanometer bandwidth.

28. A device, as recited in claims 1, 14, or 17, wherein the improvement further comprises:

a) means for the synthesis of said directed beam of light from sources of at least two different spectral distributions, for viewing and recognition by said attending user of surfaces having indicia thereon in black and white and in multiple colors of the visible spectra.

29. A device, as recited in claim 28, wherein said means for synthesis of spectral light and energy distributions comprises:

a) said illumination subassembly further comprising:
at least one lamp, operative in a first color spectral bandwidth of the visible light spectrum, responsive to an unidirectional flow of direct current in a first connecting circuit of said electrical power;
at least one lamp, operative in a second color spectral bandwidth distribution of said visible light spectrum, different from said first color spectral bandwidth, responsive to bidirectional flows of direct current in a different connecting circuit of said electrical power; and b) means, accessible to said attending user, for reversing the polarity of said direct current flow in said device which selectively changes said spectral light and energy distribution of said directed beam from the colors of a composite of said first and second color spectra to the colors of said second color spectra of said array which is operative upon said bidirectional flows of direct current.

30. A device, as recited in claim 29, wherein said means for reversing the polarity of said direct current flow comprises:

a) at least one battery for an electrical power supply; and b) a receptacle in said device, accessible to said attending user, for insertion and replacement of said batteries in a selected direction therein for either normal or reversed direct current polarities.

31. A device, as recited in claim 28, wherein said means for synthesis of spectral light and energy distributions comprises:

a) said illumination subassembly further comprising:
at least one lamp, operative in a first color spectral bandwidth distribution of the visible light spectrum, which is responsive to a flow of direct current in a first direction in a first connecting circuit of said electrical power;
at least one lamp, operative in a second color spectral bandwidth distribution of said visible light spectrum that is different from said first color spectral bandwidth distribution, which is responsive to a flow of direct current in a second direction in a different connecting circuit of said electrical power; said first and second directions of direct current flow being responsive to opposite polarities of said electrical power; and b) means accessible to said attending user, for reversing the polarity of said electrical power in said device, for alternatively selecting said directed beam of light from said first or second color spectral distributions.

32. A device, as recited in claim 31, wherein said means for reversing the polarity of said direct current flow comprises:

a) at least one battery for an electrical power supply; and b) a receptacle in said device, accessible to said attending user, for insertion and replacement of said batteries in a selected direction therein for either normal or reversed direct current polarities.

33. A flashlight, operable by an attending user for signaling and for illuminating multicolored surfaces, which comprises:

a) an opaque housing having an exit aperture for projecting a beam of light through a shielding hood;

b) an electrical power supply comprising at least one replaceable battery which may be installed, by said user, alternatively in normal and reversed polarities;

c) an illumination subsystem operative to generate light upon application of said electrical power and rapidly responsive to disconnection of said electrical power yielding a short decay time span for projection of light, which subsystem comprises:

at least one array of light emitting lamps operative at a first spectrum of colors upon an unidirectional flow of direct current in said emitting lamps; and at least one array of at least one light emitting lamp operative at a second spectrum of colors, different from said first color spectrum, upon reverse and bidirectional flows of direct current in said emitting lamp;

d) a luminous intensity control subsystem for said projected beam of light, comprising:

a first light polarizing lens interposed between said illumination subsystem and said housing exit aperture;

a second light polarizing lens successively interposed between said first light polarizing lens and said housing exit aperture; and means, operable by said attending user, for differentially adjusting the planes of polarization of said first and second polarizing lenses in a range between parallel and crossed planes of polarization for continuous variation of said luminous intensity of projected light between the available maximum and minimum levels, respectively.

e) an electrical switching subsystem for connection of said power supply to said illumination subsystem, comprising:

a gravity actuated switch for the automatic connection of said power supply to said illumination subsystem when said flashlight is aimed to project said beam of light downward within a defined conical volume centered within a small acute included angle about the vertical direction, and for the automatic disconnection of said power supply from said illumination subsystem when said flashlight is aimed to project said beam of light in spaces outside said defined conical volume;

an override switch, manually operable by said attending user, for connection of said power supply to said illumination subsystem irrespective of the aiming direction of said flashlight; and means, manually operable by said attending user, for disabling said gravity actuated switch for locking said flashlight in an OFF status; and f) means for coordinating said electrical switching subsystem and said luminous intensity control subsystem for restricting initiation of the turn-on of said beam of light to coincide with said minimum intensity level effected by crossed planes of polarization of said intensity control subsystem.

34. A flashlight, operable by an attending user for projecting a beam of light for signaling and for illuminating multicolored surfaces, which comprises:

a) a cylindrical tubular housing of opaque material open at each end, which comprises:

a first end of said tubular housing for a light exit aperture, for assembly therein of a light polarizing optical module, said first housing end having a male threaded segment thereon and at least one keyway slot for angular registry of said polarizing optical module; and a second end of said tubular housing for assembly therein of a removable flashlight cartridge, said second housing end having in proximity and parallel to said second end a slot with a gravity switch off-cam extending circumferentially approximately ninety degrees in said housing, for locking said cartridge in place and for setting a range of variable luminous intensity control;

b) a hood of opaque insulating material having matching female threads therein for assembly upon said first end of said tubular housing, for securing said optical module and for shielding said light exit aperture from side view;

c) said optical module, comprising;

an outer lens;

a first polarizer lens for said variable luminous intensity control;

a keyway pin for registry of said polarizer lens in said housing; and an O-ring for sealing said flashlight against entry of foreign substances;

d) said flashlight replaceable cartridge, comprising:

a mechanical structure comprising a cage of at least three electrically conducting struts for assembly of said cartridge;

at least one dry cell battery for removable placement within said structural cage;

an interchangeable lamp module of optional design for removable attachment to the inner end of said structural cage for emission of light, said lamp module comprising input and output contacts for an electrical circuit supplied with power from said battery; at least one light emitting lamp; and a second polarizing lens for said variable luminous intensity control;

an electrical switching subassembly enclosed within the outer end of said structural cage for completing a conducting circuit from said battery to said lamp module;

a control cap attached to said electrical switching subassembly, said control cap comprising: a raised surface remaining outside said flashlight housing for operation by said attending user when said cartridge is assembled in said housing; a spring loaded locking pin for placement in said slot and said gravity switch off-cam of said housing; a manually operable override switch connecting shaft and thumb lever; and, a second O-ring for sealing said flashlight against entry of foreign substances; and e) means for rotating said cartridge, about its long axis, within said cylindrical flashlight housing for initiating said projection of light and for varying said luminous intensity of the projected light beam.

35. A flashlight, as recited in claim 34, wherein said electrical switching subassembly, comprises:

a) an insulated retaining cup for assembly to said conducting cartridge cage, said retaining cup comprising an open top and an aperture through the base thereof, said aperture positioned for contact with at least one conducting strut of said cartridge cage.

b) an encased gravity actuated electrical switch for insertion within said insulated retaining cup; said gravity switch comprising a sealed electrically conducting case for contact with a terminal of said battery; a conducting liquid within said conducting case; and a conducting contact and output terminal post, insulated from said case, for projecting through said retaining cup aperture for contact with said cage conducting strut; a retaining ring for securing said gravity switch within said insulated cup; and means, operable by said attending user, for opening the electrical circuit from said battery through said gravity switch to said conducting cage strut for achieving an off-status for said flashlight; and c) an override switch, manually operable by said attending user, comprising: a permanent isolated and insulated electrical conducting circuit from a terminal of said battery to a contact terminal of said override switch; and means for manually closing said override contact terminal upon said cage conducting strut for completion of said conducting circuit from said battery to said lamp module.

36. A flashlight, as recited in claim 34, wherein said interchangeable lamp module further comprises:

a) a modular case of insulating materials for support of a multiplicity of light emitting lamps and for rotation with said cartridge;

b) an incandescent filament lamp, responsive to bidirectional flows of current;

c) an optical filter for absorbing red energies of the light emitted by said incandescent filament when energized;

d) an array of multiple light emitting diode lamps, responsive only to unidirectional flow of said electrical current, for the emission of light comprising at least one color spectra different from the filtered spectra of said incandescent filament lamp;

e) a second polarizing lens permanently attached to said modular case to polarize the composite emissions of all of said light emitting diodes and said incandescent filament lamps; and f) means for connecting an electrical circuit from an adjacent battery terminal through said multiplicity of lamps to said conducting cartridge cage strut for return current flow to said battery.

37. A flashlight, as recited in claim 34, which further comprises:

a) a tactile generator, removably insertable in said cartridge cage, for automatically alerting said attending user through the sense of touch that light is being projected in a high risk direction, said tactile generator comprising:

a cylindrical container comprising insulating material for insertion within said cartridge cage said tactile container further comprising: longitudinal keyways in the outer surface of said container distributed to receive said cage conducting struts therein; an internal cavity in said container, and means for penetrating the shell of said container with input and return electrical conductors;

an automatic gravity actuating electrical switch inserted and physically oriented in said container cavity for automatic closure of an electrical circuit to said battery only when said flashlight is aimed to project light in said high risk directions; and an electrically driven vibrating mass connected within said container cavity to said accompanying gravity switch and said electrical circuit for stimulating said touch of said attending user.

38. A flashlight, as recited in claim 34, wherein said interchangeable lamp module still further comprises:

a) at least one light emitting diode lamp for reducing the decay time span in extinguishing said beam of light from said flashlight when said battery power is disconnected from said lamp module.

39. A flashlight, as recited in claim 34, wherein said interchangeable lamp module still further comprises:

a) at least one electroluminescent lamp for reducing the decay time span in extinguishing said beam of light from said flashlight when said battery power is disconnected from said lamp module.

40. A device, operative by a user on the application of electrical power, for the projection of light in a directed beam at a desired intensity, wherein the improvement comprises:

a) an illumination subassembly comprising:

a first light source, operative to project from said device light in a first color spectral bandwidth distribution of the visible light spectrum;

a second light source, operative to project from said device light in a second color spectral bandwidth distribution of said visible light spectrum that is different from said first color spectral bandwidth distribution;

b) circuit means for connecting said illumination subassembly to said electrical power;

c) means operable without intensity control of the directed beam for automatically reducing the decay time span for extinguishing the projected light when said electrical power is disconnected from said illumination subassembly; and d) means accessible to said attending user for altering the flow of current in said circuit for changing the color of said directed beam of light.

41. A device, as recited in claim 40, wherein said means for changing said color of said light beam comprises:

a) said first light source, responsive to a flow of current in a first direction in a connecting circuit to said electrical power;

b) said second light source, responsive to a flow of current in a second direction in said connecting circuit in reverse to said first direction of current flow; and c) a switch in said connecting circuit of said electrical power for selection, responsive to an attending user, between said first and second directions of current flow.

42. A device as recited in claim 40, wherein the improvement further comprises:

a) a battery power supply;

b) a battery compartment to enclose said battery;

c) means to reverse the position of said battery in said battery compartment to effect reversal of polarity of said electrical power and a corresponding change in color.

43. A device according to claim 40, wherein one of said selectable directed beam colors is of the blue or green band of the visible spectrum of colors.

44. A device, operative on the application of electrical power, for the projection of light in a directed beam, wherein the improvement comprises:

a) an illumination subassembly, responsive to said application of electrical power, comprising at least one lamp;

b) a circuit means for connecting said illumination subassembly to said electrical power;

c) a control system, operable by an attending user, for dimming and polarizing the directed light beam coordinated with the disconnection of said electrical power for extinguishing the projection of light from said device, wherein said control system comprises:

first and second polarizing filters, operative differentially by said user, between parallel and cross planes of polarization of said directed beam; and an on-off switch for said electrical power keyed to activate said illumination subassembly at a predetermined level of luminous intensity of said directed beam.

* * * * *